United States Patent [19]

Pace

[11] Patent Number: 4,750,723

[45] Date of Patent: Jun. 14, 1988

[54] DEVICE FOR SUPPORTING WORKPIECES

[75] Inventor: Paul G. Pace, Hollywood, Calif.

[73] Assignee: Barry Wright Corporation, Newton Lower Falls, Mass.

[21] Appl. No.: 93,423

[22] Filed: Sep. 4, 1987

[51] Int. Cl.[4] ..... B25B 1/00

[52] U.S. Cl. ..... 269/310

[58] Field of Search ..... 269/309, 310, 20, 27, 269/30, 296; 188/67, 129; 248/402, 411, 412

[56] References Cited

U.S. PATENT DOCUMENTS 3,421,750 1/1969 Tridgell ..... 269/310

*Primary Examiner*—Robert C. Watson

*Attorney, Agent, or Firm*—Milton E. Gilbert; James W. Mitchell

[57] ABSTRACT

An adjustable device for supporting workpieces having two sets of relatively movable interleaved friction plates, one set attached to and movable with a work supporting plunger, the other being relatively stationary with respect to the plunger. The plunger and associated plates are moved into work supporting engagement by air pressure; the two sets of plates being clamped together by a hydraulic piston operated at right angles to the plates, to hold the plunger in the desired work supporting position of adjustment until the sets of plates are unclamped.

10 Claims, 4 Drawing Sheets

DEVICE FOR SUPPORTING WORKPIECES

FIELD OF THE INVENTION

The present invention relates to devices for supporting a workpiece while machining processes are being performed on the workpiece and more particularly to a work supporting device in which a movable work supporting plunger is supported by two relatively movable sets of interleaved friction plates which are clamped together to hold the plunger in a desired work supporting position of adjustment.

BACKGROUND OF THE INVENTION

While being machined, workpieces are frequently retained in a holding fixture by resting the workpiece on two or more spaced apart pads on which the workpiece is clamped. The work pads on the holding fixture are usually small in area in order to facilitate cleaning of their operative faces and also to minimize the contact area of the locating surface on the workpiece. This reduces to a minimum the distortion resulting from possibly non-planar locating surfaces on the workpiece. However, with such an arrangement relatively large portions of the workpiece are unsupported and subject to deflection by the forces created during the machining operation. It is desirable to stabilize these unsupported portions by suitable means. When these un-supported portions are or irregular contour their locating positions are not readily predetermined and, therefore, a fixed height support cannot be used. Each successive workpiece may require a different height of supporting device. Another requirement is that, regardless of the device used to support the workpiece, it must not exert an excessive amount of initial contacting force on the workpiece. If the supporting device bears against the workpiece with excessive force, the workpiece will distort from its normal configuration and the machining operation will be performed under this abnormal condition. Thereafter, when the finished workpiece is removed from the work-holding fixture, it will return to its normal shape and the machined portion will not conform to the desired configuration and size.

A variety of devices have been used in the past to solve the above-mentioned problems, but none has been completely satisfactory for various reasons.

Many devices are of course known for such a purpose, but all of these have certain disadvantages. Thus screw-operated jacks are known but these have the disadvantage that excessive load can accidentally be applied to the work-piece when positioning the jack, which may shift or even distort it. Wedge-type jacks are also known which are locked by hydraulic pressure but in the case the load which can be supported is relatively low, and a further notable disadvantage lies in the fact that the load on the jack is transmitted back into the hydraulic system. Again, hydraulically locked work supports are known in which hydraulic pressure is employed to clamp collets or a sleeve about a sliding plunger which supports the workpiece, but the load which can be supported is again limited and also the friction surfaces on the plunger and the sleeve or collets have to be formed to very close tolerances. Other hydraulically locked work supports are known in which hydraulic pressure is employed to lock a series of plates together which provide support to a vertical support plunger. In such devices a spring generated force between the two sets of interleaved plates, one stationary and one movable, generate a transmitted force between the plates which is greater than desired.

Accordingly a principal desirable object of the present invention is to provide an improved device for supporting workpieces.

Another desirable object of the invention is to provide an improved device for supporting workpieces having a movable work supporting plunger which is supported by two relatively movable sets of interleaved friction plates which are clamped together preferably by a hydraulic piston operating at right angles to the plates, to hold the plunger in a desired work supporting position of adjustment.

Other desirable objects and advantages of the invention will in part appear hereinafter and will in part become apparent after consideration of the specification with reference to the accompanying drawing.

SUMMARY OF THE INVENTION

In accordance with the present invention there is provided a device for adjustably supporting a workpiece comprising a housing with a bore having an open end and a closed end, a support member or plunger movable relative to the longitudinal axis of the bore and having an inner end disposed in the bore and an outer end extended from the open end of the bore for work-supporting engagement. First and second interleaved sets of friction plates are disposed in the bore between the inner end of the plunger and the closed end of the housing and have their planes parallel with the longitudinal axis of the bore. A first plate retainer means is associated with the inner end of the plunger and movable therewith and has a plurality of upper slots for receiving a portion of the upper ends of the first set plates. Bias means are associated with the upper slots and the upper ends of the first set of plates for urging the upper ends into the slots and into contact with the first plate means. A second plate retainer means is associated with the closed end of the housing and has a plurality of lower slots for receiving a portion of the lower ends of the second set of plates. Bias means are associated with the lower slots and the lower ends of the second set of plates for urging the lower ends into the slots and into contact with the second retainer plate. There is also provided a fluid pressure operable means movable to clamp the first and second sets of plates together whereby the sets of plates serve to support the plunger against inward movement relative to the closed end of the bore, the sets of plates being relatively movable when the fluid pressure operable means is not operated to thereby permit relative movement of the plunger relative to the bore. Final adjustment of the plunger in a desired work supporting position with the friction plates in the desired relative longitudinal position for clamping is preferably accomplished with fluid pressure, preferably air pressure, exerted against the first or upper plate retainer associated with the plunger.

BRIEF DESCRIPTION OF THE DRAWINGS

For a fuller understanding of the nature and desired objects of the invention, reference should be had to the following detailed description taken in connection with the accompanying drawings wherein like reference characters denote corresponding parts throughout the several views and wherein.

DETAILED DESCRIPTION OF PREFERRED EMBODIMENT(S)

Figure 1:
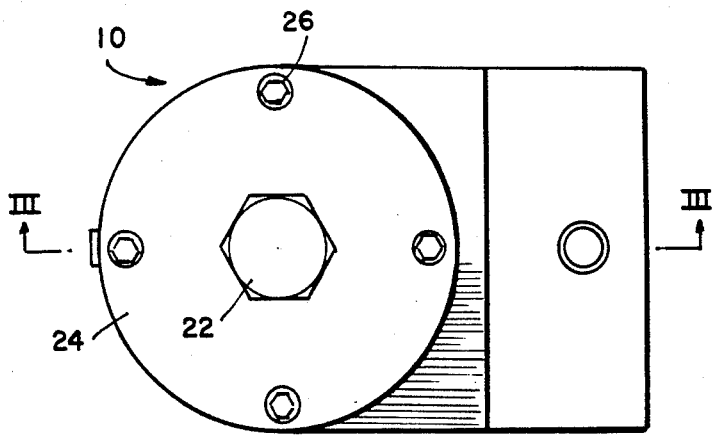
FIG. 1 is a top elevational view of a device for supporting workpieces in accordance with the present invention.
Figure 2:
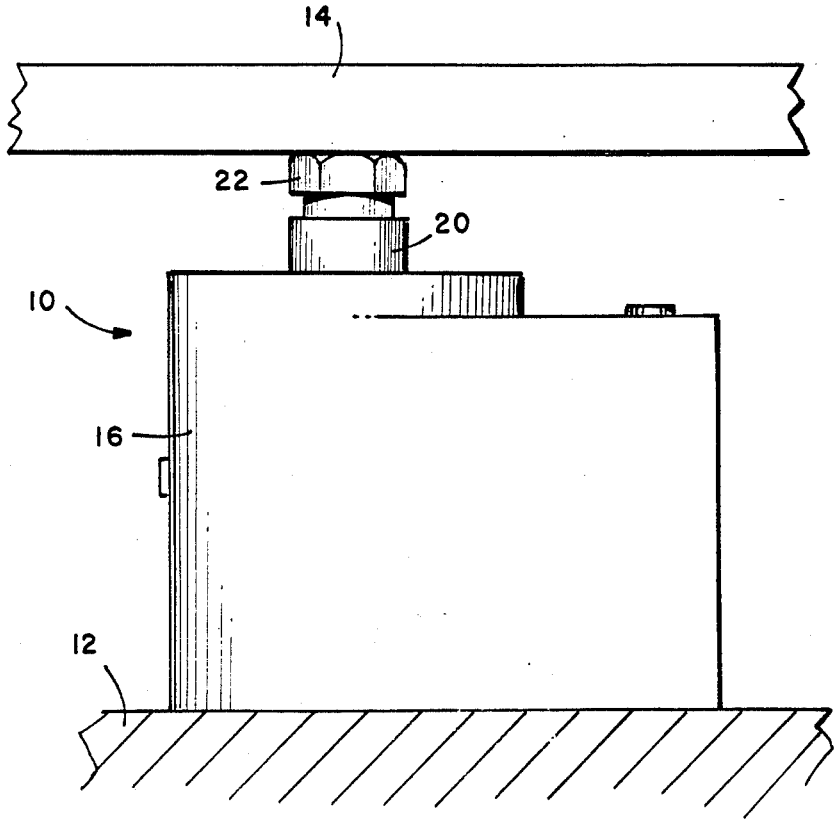
FIG. 2 is a side elevational view of the device of FIG. 1 in position on a work table supporting a workpiece.
Figure 3:
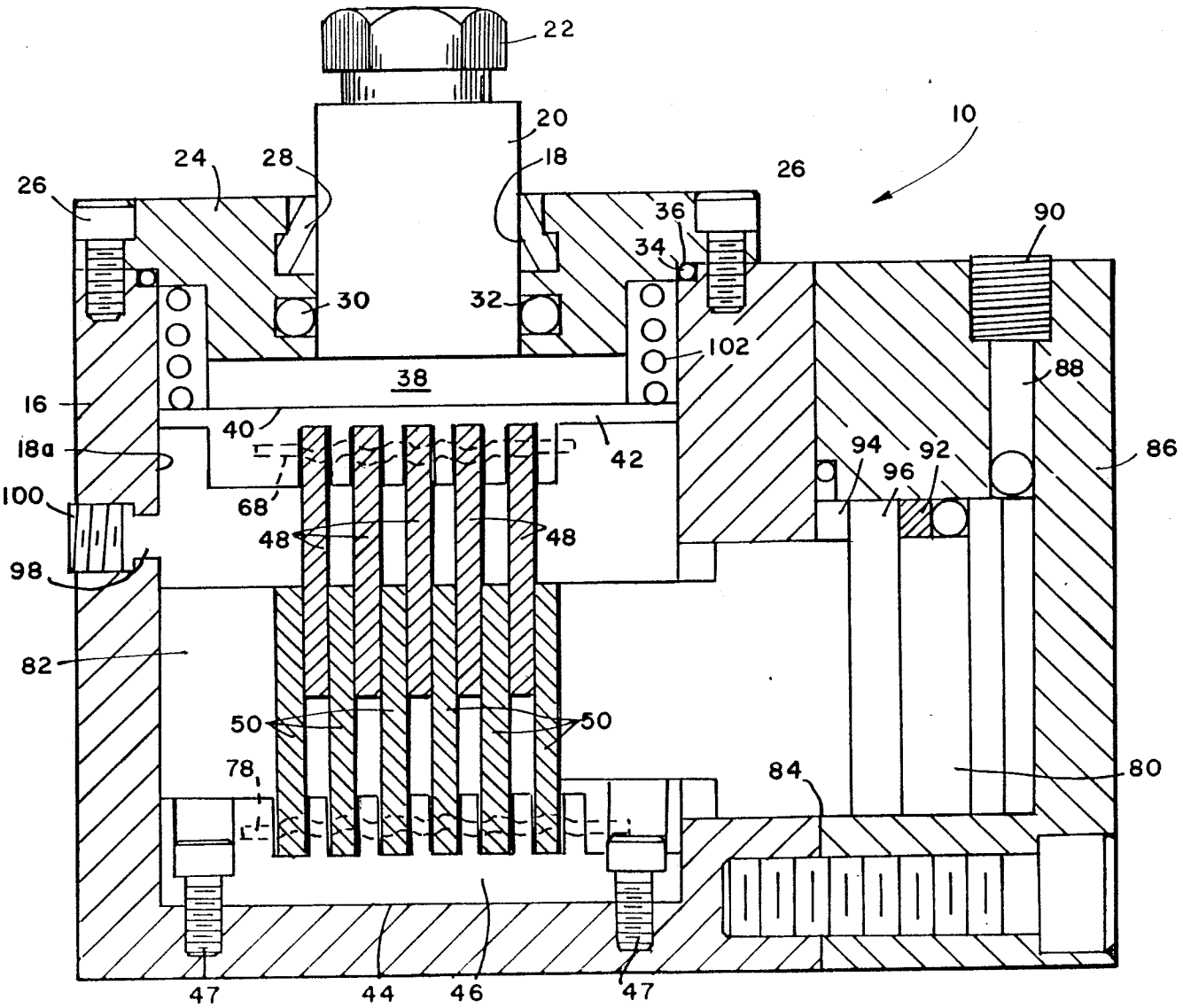
FIG. 3 is a vertical sectional view taken substantially on the line 3—3 of the device of FIG. 1.
Figure 8:
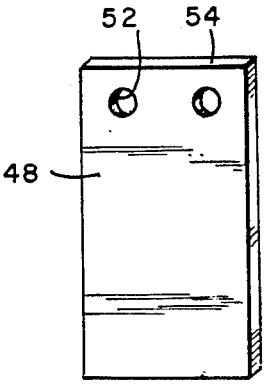
FIG. 8 is a perspective view of a friction plate representative of the upper set of plates attached to the upper plate retainer of the type illustrated in FIGS. 4 and 5.
Figure 9:
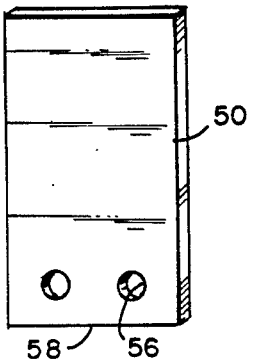
FIG. 9 is a perspective view of a friction plate representative of the lower set of plates attached to the lower plate retainer of the type illustrated in FIGS. 6 and 7.

Referring now to the drawings, the work support device of the present invention, illustrated generally by the numeral 10, can in one mode of use as shown in FIG. 2 be secured on the surface of a work table 12 and is located in a position to underlie the unsupported area of a workpiece 14 which is normally secured to the work table by any known means located at spaced distances from each other. In accordance with the invention, the work support device 10 includes a housing 16 having a central passage or bore 18 in which a support member for workpieces in the form of a plunger 20 is movable relative to the longitudinal axis of the bore. The plunger 20 has an outer end portion 22 for engagement with the workpiece 14. The upper portion of the housing 16 is preferably in the form of a removable cover 24 secured to the main housing by suitable means such as bolts 26. Disposed about the plunger 20 in the bore 18 is a plunger wiper 28 which serves to prevent foreign matter such as dirt and dust from entering the device housing. The plunger 20 is sealed in the bore 18 by means of o-ring seal 30 provided in groove 32. In a similar manner the cover 24 is sealed to the housing 16 by means of o-ring seal 34 provided in groove 36. The plunger 20 is radially enlarged at its inner end to form an integral disc 38 having a lower surface 40. Attached to the lower surface 40 or formed as an integral part thereof is a first or upper frictional plate retainer member 42 which is sufficiently radially larger than disc 38 so as to be in slidable contact with the enlarged bore section 18*a*. Disposed upon the closed end or base 44 of the housing (the closed end of the bore 18), is a lower frictional plate retainer 46 corresponding to the upper plate retainer 42. Within the housing 16 and the lower portion 18*a* of the bore 18 are two interleaved sets of frictional plates, namely an upper set 48 and a lower set 50. All of the plates 48 and 50 are separate members, however the upper plates 48 are each formed with a pair of apertures 52 disposed adjacent the upper surface 54 of each plate and the lower plates 50 are formed with a pair of apertures 56 adjacent the lower surface 58 of each plate (as best seen in FIGS. 8 and 9).

Figure 4:
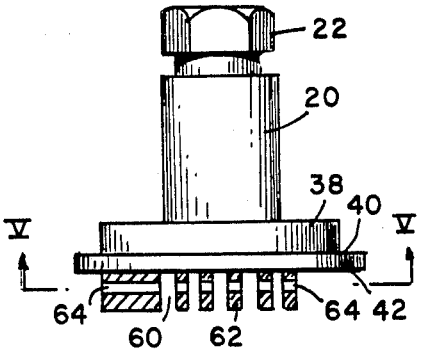
FIG. 4 is a side elevational view illustrating the assembly of the plunger and associated plate retainer of FIG. 3.
Figure 5:
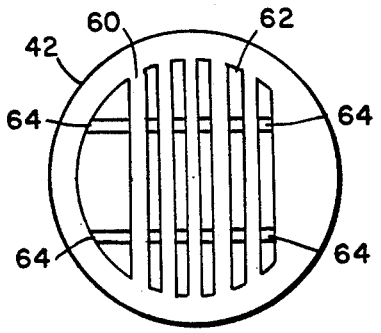
FIG. 5 is a bottom elevational view of the plate retainer of FIG. 4.
Figure 6:
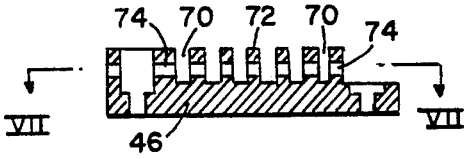
FIG. 6 is a side elevational view illustrating the lower 10. plate retainer associated with the closed end of the housing of the device of FIG. 3.
Figure 7:
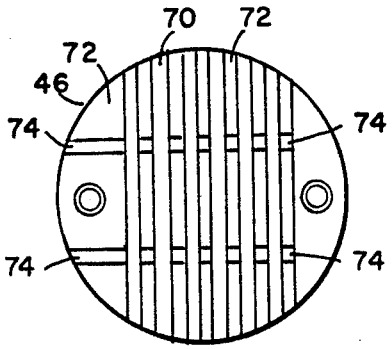
FIG. 7 is a top elevational view of the plate retainer of FIG. 6.
Figure 10:
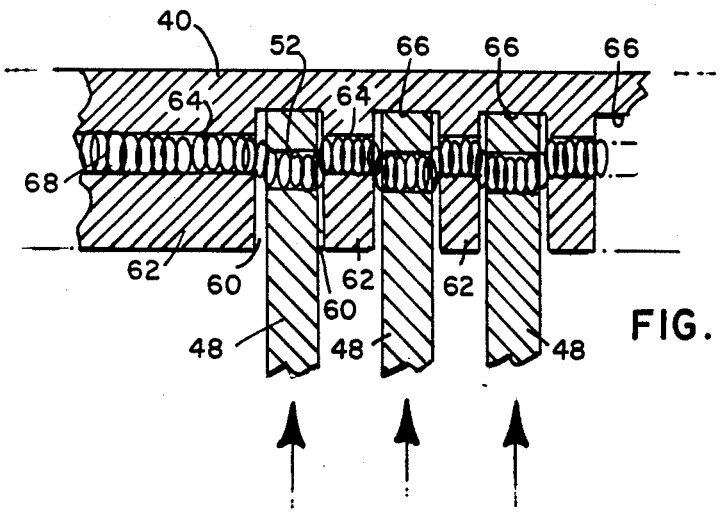
FIGS. 10 and 11 are enlarged fragmentary cross-sectional views respectively of the upper and lower retainer plates illustrating the means for maintaining the frictional plates in contact with the slots of the retainer plates.
Figure 11:
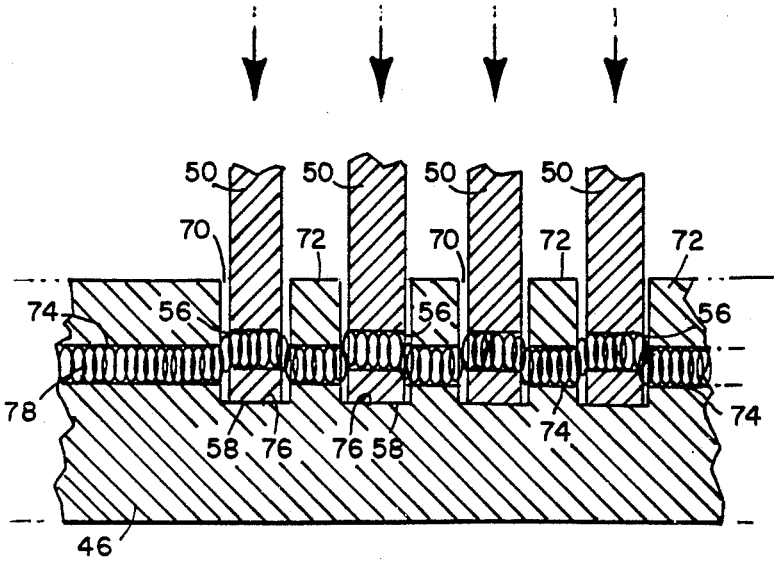

Referring now more particularly to FIGS. 4, 5, and 10 the assembly of the upper plate retainer with the upper plates 48 is illustrated. The upper retainer 42 is provided with a plurality of slots 60 and rib members 62. The ribs 62 are preferably provided with two rows of parallel apertures 64 which are offset from the plate apertures 52 in a plane closer to the inner surfaces 66 of slots 60. In this manner when a pair of helical tension springs 68 are inserted through the apertures 64 of the ribs 62 and apertures 52 of plates 48, the plates 48 are biased toward the retainer plate to insure that the upper surface 54 of each plate is maintained in continuing engagement with the surface 66 of slots 60. The lower plate retainer 46 and associated plates 50, as best seen in FIGS. 5, 6, and 11 are assembled in a manner similar to the upper plate retainer assembly. The lower plate retainer 46 is provided with a plurality of alternating slots 70 and rib members 72. The rib members 72 are preferably provided with two parallel rows of apertures 74 which are offset from the plate apertures 56 in a plane closer to the inner surfaces 76 of the slots 70. In this manner when a pair of helical tension springs 78 are inserted through the apertures 74 of ribs 72 and the apertures 56 of plates 50, the plates 50 are biased downwardly toward the lower plate retainer 46 to insure, as with the upper plate retainer, that lower surface 58 of each plate 50 is maintained in continuing engagement with the surface 76 of each slot 70. In this manner the continuity of engagement of the upper and lower plate members with their respective plate retainers is ensured. The upper plate retainer 40 and plates 48 as so assembled follow the movement of the plunger 20 as it moves within the bore section 18 and 18*a*. The lower plate retainer 46 is secured to the housing by suitable bolts 47. The means for clamping the sets of friction plates together against relative sliding movement are provided in the form of a piston 80 and back-up block member 82. The piston 80 is slidable in a bore 84 in an extension 86 of the housing 16. A bore 88 with an internally threaded portion 90 is provided in housing 86 for connection to a source (not shown) of fluid pressure. Application of fluid pressure to the piston 80 via the bore 88 will cause the piston 80 to move inwardly to clamp the sets of plates 48 and 50 together between the piston and back-up block 82 and thus prevent inward movement of the plunger 20 under load in any load-supporting position of the plunger. The piston 80 is provided with an o-ring seal 92 and a compression spring means 94 positioned adjacent flange 96 and housing 16 such as a wave spring to return the piston 80 to its inoperative position when the fluid pressure is released and whereby the friction plates are released for further relative sliding movement of piston 80 between the clamped and unclamped positions need only be very small. Additionally the mounting of the sets of plates 48 and 50 in the slots together with the tension springs allows sufficient lateral movement of the sets of plates, which also need only be very small, allows them to be easily clamped and unclamped by slight movement of the piston.

In the preferred embodiment of the invention the plunger 20 and associated set of upper friction plates is moved upwardly into supporting engagement with the workpiece by fluid pressure operable means such as, for example, air pressure. In this embodiment, application of the air pressure is via bore 98 which has an internally threaded portion 100 for connection to a source of air pressure (not shown). Application of air pressure through bore 98 to that portion 18*a* of bore 98 will cause the upper plate retainer 42 and associated plates 48 to move upwardly together with plunger 20 thereby bringing the plunger into supporting engagement with the workpiece and at this point the piston is activated to clamp the plates in position as described above. In this embodiment it is preferred to provide the plunger assembly with a spring return means such as compression spring 102 operable to return the plunger to its inoperative position when the air pressure thereon is released and the plate set unclamped.

It is believed apparent that the present invention provides a simple, inexpensive, easily adjustable device for supporting a workpiece.

While the invention has been described with 15. respect to 15. preferred embodiments it will be apparent to those skilled in the art that changes and modifications may be made without departing from the scope of the invention herein involved in its broader aspects. Accordingly, it is intended that all matter contained in the above description, or shown in the accompanying drawing shall be interpreted as illustrative and not in limiting sense.

What is claimed is:

1. A device for adjustably supporting a workpiece comprising:

a housing with a bore having an open end and a closed end;

a plunger movable relative to the longitudinal axis of said bore and having an inner end disposed in said bore and an outer end extending from the open end of said bore for work supporting engagement;

first and second interleaved sets of friction plates disposed in said bore between the inner end of said plunger and said closed end and having their planes parallel with the longitudinal axis of said bore;

a first plate retainer means associated with the inner end of said plunger and moveable therewith and having a plurality of upper slots for receiving a portion of the upper ends of the first set plates;

first means associated with said upper slots and the upper ends of said first set of plates for urging said upper ends into said slots and into contact with said first plate retainer means; said first means including a spring threaded through adjacent misaligned holes in the first plate retainer means and the first set of plates;

a second plate retainer means associated with the closed end of said housing, and having a plurality of lower slots for receiving a portion of the lower ends of the second set of plates;

second means associated with said lower slots and the lower ends of said second set of plates for urging said lower ends into said slots and into contact with said second plate retainer means; said second means including a spring threaded through adjacent misalignment holes in the second plate retainer means and the second set of plates; and a fluid pressure operable means movable to clamp the said first and second sets of plates together whereby said sets of plates serve to support said plunger against inward movement relative to the closed end of said bore;

said sets of plates being relatively movable when said fluid pressure operable means is not operated to thereby permit said relative movement of said plunger.

2. A device for adjustably supporting a workpiece comprising:

a housing with a bore having an open end and a closed end;

a plunger movable relative to the longitudinal axis of said bore and having an inner end disposed in said bore and an outer end extended from the open end of said bore for work-supporting engagement;

means urging said plunger outwardly of said bore and into work-supporting engagement;

first and second interleaved sets of friction plates disposed in said bore between the inner end of said plunger and said closed end and having their planes parallel with the longitudinal axis of said bore;

a first plate retainer means associated with the inner end of said plunger and movable therewith and having a plurality of upper slots for receiving a portion of the upper ends of the first set of plates;

first means associated with said upper slots and the upper ends of said first set of plates for urging said upper ends into said slots and into contact with said first plate means; said first means including a spring threaded through adjacent misaligned holes in the first plate retainer means and the first set of plates;

a second plate retainer means associated with the closed end of said housing, and having a plurality of lower slots for receiving a portion of the lower ends of the second set of plates;

second means associated with said lower slots and the lower ends of said second set of plates for urging said lower ends into said slots and into contact with said second retainer plate; said second means including a spring threaded through adjacent misaligned holes in the second plate retainer means and the second set of plates; and a fluid pressure operable means movable to clamp the said first and second sets of plates together whereby said sets of plates serve to support said plunger against inward movement relative to the closed end of said bore;

said set of plates being relatively movable when said fluid pressure operable means is not operated to thereby permit said relative movement of said plunger.

3. A device for adjustably supporting a workpiece comprising:

a housing with a bore having an open end and a closed end;

a plunger movable relative to the longitudinal axis of said bore and having an inner end disposed in said bore and an outer end extended from the open end of said bore for work-supporting engagement;

a first fluid pressure operable means urging said plunger outwardly of said bore and into work supporting engagement;

first and second interleaved sets of friction plates disposed in said bore between the inner end of said plunger and said closed end and having their planes parallel with the longitudinal axis of said bore;

a first plate retainer means associated with the inner end of said plunger and movable therewith and having a plurality of upper slots for receiving a portion of the upper ends of the first set plates;

means associated with said upper slots and the upper ends of said first set of plates for urging said upper ends into said slots and into contact with said first plate means;

a second plate retainer means associated with the closed end of said housing, and having a plurality of lower slots for receiving a portion of the lower ends of the second set of plates;

means associated with said lower slots and the lower ends of said second set of plates for urging said lower ends into said slots and into contact with said second retainer plates; wherein said first and second sets of plates are connected to their respective plate retainer means by helical tension springs passing through adjacent aperatures disposed in said plates and plate retainers, and a second fluid pressure operable means movable to clamp the said first and second sets of plates together whereby said sets of plates serve to support said plunger against inward movement relative to the closed end of said bore;

said sets of plates being relatively movable when said fluid pressure operable means is not operated to thereby permit said relative movement of said plunger.

4. The device in accordance with claim 3 wherein said second set of plates is substantially stationery adjacent the lower end of said bore and said first set of plates are movable relative thereto and relative to the longitudinal axis of said bore.

5. The device in accordance with claim 3 wherein said means associated with the upper slots and the upper ends of said first set of plates comprises resilient spring means operative to bias said upper ends into contact with said slot means.

6. The device in accordance with claim 3 wherein said means associated with said lower slots and the lower ends of said second set of plates comprises resilient spring means operative to bias said lower ends into contact with said slot means.

7. The device in accordance with claim 3 further including spring means operative continually to urge said plunger inward relative to the closed end of said bore.

8. The device in accordance with claim 3 wherein said housing has a second bore formed in a wall thereof and the said fluid operable means comprises a piston slidable in said second bore and directly engageable with the surface of an end plate by movement perpendicularly to the longitudinal axis of the bore.

9. The device in accordance with claim 3 wherein the apertures in said plates are sufficiently offset relative to the apertures in said plate retainers whereby said helical springs bias said plate toward and contact with their respective retainer plates.

10. The device in accordance with claim 3 wherein said housing comprises a sealed chamber.

* * * * *